US007295110B2

(12) United States Patent
Mercier et al.

(10) Patent No.: US 7,295,110 B2
(45) Date of Patent: Nov. 13, 2007

(54) LOCKING STORAGE DEVICE AND METHOD OF DEPOSITING AND REMOVING AN OBJECT IN/FROM SAID DEVICE

(75) Inventors: Antoine Mercier, Montmorency (FR); Florence Hirel, Chantillon (FR)

(73) Assignee: E-Box Sarl, Paris (FR)

( * ) Notice: Subject to any disclaimer, the term of this patent is extended or adjusted under 35 U.S.C. 154(b) by 202 days.

(21) Appl. No.: 10/545,531

(22) PCT Filed: Feb. 5, 2004

(86) PCT No.: PCT/FR2004/000263

§ 371 (c)(1),
(2), (4) Date: Aug. 12, 2005

(87) PCT Pub. No.: WO2004/075127

PCT Pub. Date: Sep. 2, 2004

(65) Prior Publication Data

US 2006/0152339 A1 Jul. 13, 2006

(30) Foreign Application Priority Data

Feb. 13, 2003 (FR) ..... 03 01767

(51) Int. Cl.
*G08B 13/08* (2006.01)

(52) U.S. Cl. ..... 340/545.6; 340/545.1; 340/665; 340/666; 340/568.1

(58) Field of Classification Search .. 370/568.1–568.8, 370/665, 666, 545.6, 545.1, 545.2, 545
See application file for complete search history.

(56) References Cited

U.S. PATENT DOCUMENTS 4,792,270 A * 12/1988 Yoshida ..... 414/273

(Continued)

FOREIGN PATENT DOCUMENTS

DE 199 39 744 A 2/2001

(Continued)

OTHER PUBLICATIONS

French Preliminary Search Report corresponding to French Patent Application Serial No. 03/01,767 dated Sep. 17, 2003, *République Française, Institute National De La Propriete Industrielle*, 3 pages.

*Primary Examiner*—Jeffery Hofsass
*Assistant Examiner*—Hoi C. Lau
(74) *Attorney, Agent, or Firm*—Marshall, Gerstein & Borun LLP

(57) ABSTRACT

The invention relates to a locking storage device in which objects are deposited for the later removal thereof. The inventive device consists of: at least one safe-deposit box (2) which is intended to house the object and which comprises a door (3) and a lock (4), a code input device (9*a*, 9*b*), and a control unit (11) which is designed to authorise an object to be deposited therein and subsequently removed therefrom following the entry of a removal code. The device also comprises a weight sensor (14*a*, 14*b*) which supports the weight of the safe-deposit box. The aforementioned control unit is designed to determine the weight of the object contained in the safe-deposit box (2) once an object has been deposited therein, to determine the variation in the weight of the safe-deposit box when an object is being removed and to emit an alarm signal when the object has been removed if said variation does not correspond to the weight of the object.

17 Claims, 3 Drawing Sheets

U.S. PATENT DOCUMENTS

| | | | | |
|---|---|---|---|---|
| 6,028,517 | A * | 2/2000 | Sansone et al. | 340/569 |
| 6,483,433 | B2 * | 11/2002 | Moskowitz et al. | 340/568.1 |
| 2001/0045449 | A1 * | 11/2001 | Shannon | 232/19 |
| 2002/0113703 | A1 | 8/2002 | Moskowitz et al. | |

FOREIGN PATENT DOCUMENTS

| | | | |
|---|---|---|---|
| DE | 100 00 830 | A | 7/2001 |
| FR | 2 561 087 | A | 9/1985 |
| FR | 2 565 370 | A | 12/1985 |
| FR | 2 846 026 | | 4/2004 |
| WO | WO-01 31827 | A | 5/2001 |

* cited by examiner

LOCKING STORAGE DEVICE AND METHOD OF DEPOSITING AND REMOVING AN OBJECT IN/FROM SAID DEVICE

The present invention relates to a lockable storage device for depositing objects therein and for removing them therefrom. More particularly, it relates to a lockable storage device which comprises at least one safe-deposit box, intended to contain an object, which includes a door capable of being kept in the closed position by at least one lock, a code entry device and a control unit, said control unit being designed to authorize an operation to deposit an object and an operation to withdraw said object following the entry of a withdrawal code, and to control the operation of keeping the door in the closed position between said deposition operation and said withdrawal operation.

Lockable storage devices for depositing an object or a parcel, and then for subsequently recovering it, are well known and prove to be very practical for users. For example, a user who has ordered an object by post can use a lockable storage device to recover his order. The delivery process then takes place as follows:

- a delivery company conveys the object from the vendor to the lockable storage device;
- the delivery company performs a deposit operation, by placing the object in a safe-deposit box using a deposit code supplied for example by the operator of the lockable storage device, by the vendor of the object or by the logistics organization (the transporter); and
- the user subsequently comes to the safe-deposit box to withdraw the object that he has ordered, using a second code called the withdrawal code, supplied for example either directly by the operator of the lockable storage device or by the vendor or by the logistics organization (the transporter).

However, this withdrawal operation entails a public safety risk. This is because the lockable storage devices known hitherto do not make it possible to ascertain whether the user has deposited an unauthorized object in the safe-deposit box during the operation to remove an object. It is therefore relatively easy to use the known lockable storage devices to commit a fraudulent or malicious act, this being a major obstacle to the development of lockable storage devices in public places.

The object of the present invention is to alleviate the abovementioned drawbacks by proposing a lockable storage device that makes it possible to detect the presence of a suspect object deposited by an unauthorized person, without however unacceptably increasing the complexity and the cost of the lockable storage device.

For this purpose, the subject of the invention is a lockable storage device of the aforementioned type, characterized in that the device includes at least one weight sensor subjected to the weight of said safe-deposit box and designed to transmit a signal representative of the weight of the safe-deposit box, and in that the control unit is designed:

- to determine the weight of the object contained in the safe-deposit box after a deposit operation;
- to determine the change in weight of the safe-deposit box during an operation to withdraw said object; and
- to emit a warning signal at the end of the withdrawal operation if said change does not correspond to the weight of said object.

Thus, it is possible to verify that the user has indeed left the safe-deposit box empty after having withdrawn the object that he had come to seek. If this is not the case, the warning signal emitted by the lockable storage device allows all appropriate measures to be taken.

In the preferred embodiments of the invention, the device furthermore has one or more of the following features:

- the lock is designed to pass from a locked position, in which the door is kept closed, to an unlocked position, in which said door is released following receipt of an open command, a position detector is designed to send a closed signal when the door is in the closed position, and the control unit comprises:
  - code recognition means connected to the code entry device, which are designed to recognize at least one deposit code and at least one withdrawal code and are designed to send an open command to said lock;
  - a readable/writeable memory;
  - memory input means connected to the code recognition means, to the position detector and to the weight sensor, which are designed to write first and second weights of the safe-deposit box into said memory;
  - weight-determining means connected to the position detector and to the code recognition means, which are designed to determine the weight of an object contained in the safe-deposit box from said first and second stored weights and to store in memory said weight of the object;
  - comparison means connected to the code recognition means and to the position detector, which are designed to compare the stored weight of said object with the difference between the first and second stored weights; and
  - warning means designed to emit the warning signal according to a result transmitted by the comparison means, the code recognition means being designed to send a signal to the memory input means following recognition of a deposit code or a withdrawal code, a signal to the weight-determining means following recognition of a deposit code, and a signal to the comparison means following recognition of a withdrawal code;
- the position detector is designed to send an open signal when the door is open and the warning means are designed to emit a warning signal according to the reception of said open signal, so as to prevent an inopportune warning signal being emitted if the user has not opened the door of his safe-deposit box during the withdrawal operation;
- communication means are designed to receive information relating to the withdrawal and deposit codes that are sent by a remote database and the control unit includes means for reprogramming the code recognition means, which reprogramming means are connected to said communication means, thus the operator of the lockable storage device can remotely program the operations of depositing and withdrawing a new object following information received by the delivery company or by the vendor;
- the information received by the communication means include a deposit code and an expected weight for an object associated with said deposit code, and the control unit includes control means designed to compare said expected weight with the determined weight of said object after a deposit operation and to send the result of the comparison to the warning means so as to emit a warning signal if the deposited object differs in weight from the weight of the object that the delivery company should have deposited;

the communication means are designed to transmit to the remote database, the determined weight of an object after a deposit operation;

the communication means are designed to transmit, to the remote database, information relating to the emission of a warning signal by the warning means;

the communication means are designed to transmit, to the remote database, information relating to the signals sent by one or other of the means of the control unit, and thus the operator knows at all times what objects are contained in the lockable storage device and can verify that the deposit and withdrawal operations have been carried out normally;

the device comprises at least one plurality of safe-deposit boxes, each being provided with at least one lock, the weight sensor is subjected to the weight of the plurality of safe-deposit boxes and the control unit is designed:

to authorize the operation to deposit an object in one particular safe-deposit box among the plurality of safe-deposit boxes;

to determine the weight of the object contained in said particular safe-deposit box after the deposit operation;

to determine the change in weight of the plurality of safe-deposit boxes during the operation to withdraw the object from said particular safe-deposit box; and to emit a warning signal at the end of the withdrawal operation if said change does not correspond to the weight of said object;

the control unit includes:

code recognition means designed to recognize at least one deposit code and at least one withdrawal code;

a memory;

weight-determining means; and comparison means, the code recognition means are designed to send an open command to the lock of one particular safe-deposit box following recognition of a code for depositing an object;

the means for determining the weight of the object are designed to store the weight of said object in memory, associating said weight with said particular safe-deposit box;

the code recognition means are designed to send an open command to said at least one lock of said particular safe-deposit box following recognition of a code for withdrawing said object; and the comparison means are designed to compare the stored weight of the object, associated with said particular safe-deposit box, with the change in weight of the plurality of safe-deposit boxes;

the plurality of safe-deposit boxes is mounted on a rack and the weight sensor is subjected to the weight of said plurality of safe-deposit boxes, which allows the number of necessary weight sensors to be limited;

the rack includes a deformable cross-member which deforms under the weight of the safe-deposit boxes and the weight sensor comprises at least one strain gauge sensitive to the deformation of said cross-member;

the precision of the weight sensor is suitable for detecting any object of significant weight.

Moreover, the invention also relates to a method of depositing an object in a lockable storage device and for withdrawing it therefrom, which device comprises at least one safe-deposit box that is intended to contain said object and includes a door that can be kept in the locked position by a lock, a code entry device and a control unit, said control unit being designed to authorize an operation to deposit an object and an operation to withdraw said object following the entry of a withdrawal code, and to control the operation of keeping the door in the closed position between said deposit operation and said withdrawal operation, characterized in that a weight sensor, subjected to the weight of said safe-deposit box and designed to transmit a signal representative of the weight of the safe-deposit box, is provided and in that the method comprises the following steps:

the weight of the object contained in the safe-deposit box after a deposit operation is determined;

the change in weight of the safe-deposit box after a withdrawal operation is determined; and a warning signal is emitted if said change does not correspond to the weight of said object.

Finally, the invention also relates to a method of controlling the lockable storage device as defined above, which includes a deposit operation and a withdrawal operation of an object, characterized in that the deposit operation comprises the following steps:

a deposit code is recognized by the code recognition means;

a signal is sent by the recognition means to the memory input means;

a signal is sent by the recognition means to the weight-determining means;

an open command is sent by the recognition means to the lock;

a first weight transmitted by the weight sensor is stored in memory; and then, later, a closed signal is sent by the detector, which detects the position of the door, to the memory input means; after which a second weight transmitted by the weight sensor is stored in memory;

the weight of the object is determined by subtracting the first stored weight from the second stored weight;

the determined weight of the object is stored in memory;

and in that the withdrawal operation comprises the following steps:

a withdrawal code is recognized by the code recognition means;

a signal is sent by the recognition means to the memory input means;

a signal is sent by the recognition means to the comparison means;

an open command is sent by the recognition means to the lock;

a first weight transmitted by the weight sensor is stored in memory; and then, later, a closed signal is sent by the position detector, which detects the position of the door, to the memory input means; after which a second weight transmitted by the weight sensor is stored in memory;

the stored weight of the object is compared with the difference between the first stored weight and the second stored weight; and a warning signal is emitted if the result transmitted by the comparison means indicates that the difference between the first stored weight and the second stored weight does not correspond to the stored weight of the object.

Preferred ways of implementing the method of controlling the lockable storage device furthermore involve one or more of the following features:

the lockable storage device furthermore includes a position detector for detecting the position of the door and designed to send an open signal and the emission of a warning signal is inhibited if the warning means do not receive a signal to open the door during the withdrawal operation;

the lockable storage device furthermore includes control means designed to compare an expected weight of an object with a determined weight after a deposit operation and the deposit operation includes the following steps after the weight of the object has been determined:

the determined weight of said object is compared by the control means with the expected weight of said object; and a warning signal is emitted if the result transmitted by the control means indicates a difference between the expected weight and the determined weight of said object.

Other features and advantages of the invention will become apparent over the course of the following description, given by way of non-limiting example and with reference to the appended drawings, in which.

In the various figures, the same references have been preserved in order to denote identical or similar elements.

Figure 1:
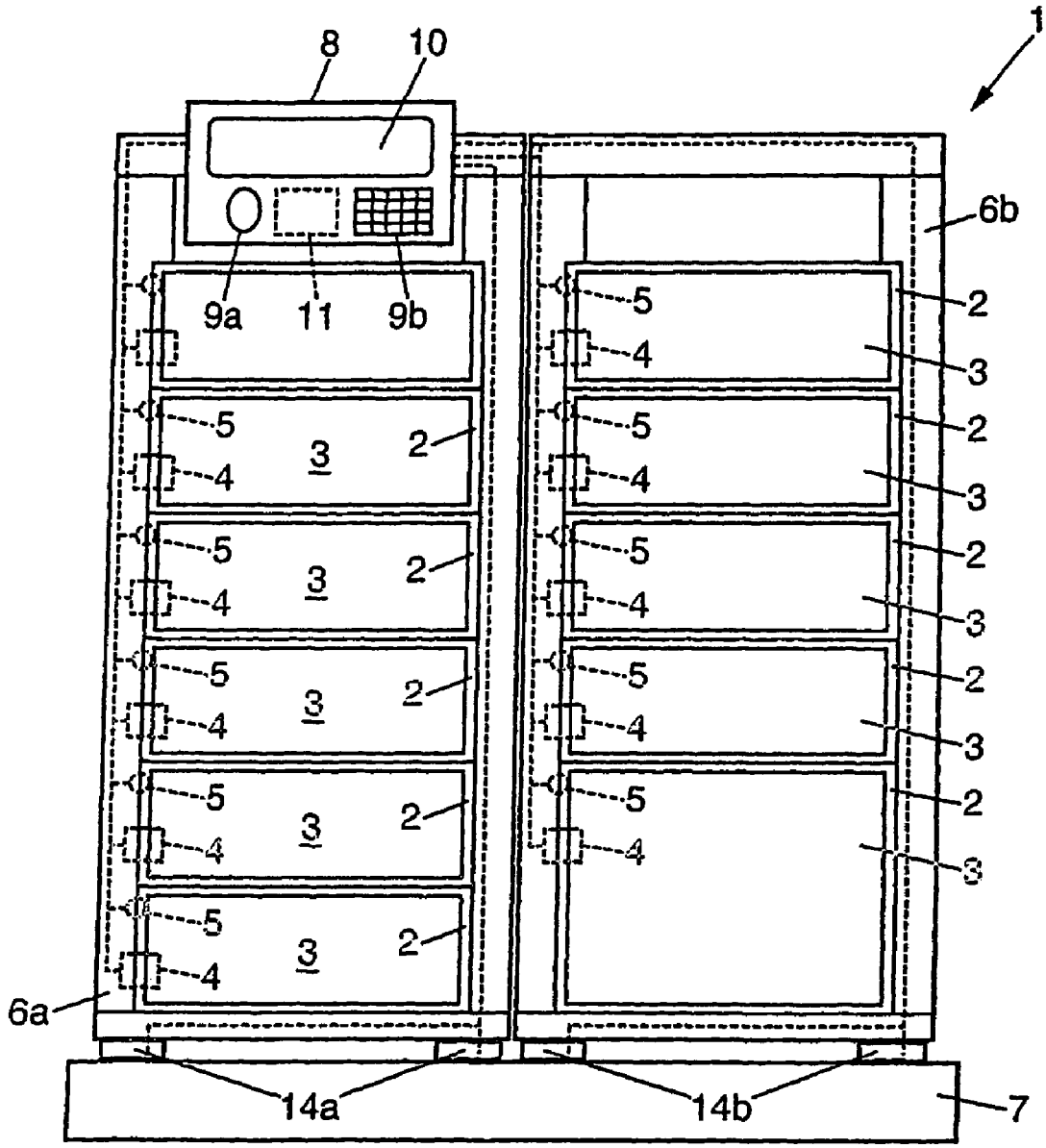
FIG. 1 is a schematic front view of a lockable storage device according to the invention.

FIG. 1 shows a lockable storage device 1 for depositing and withdrawing objects. The lockable storage device comprises a plurality of safe-deposit boxes 2 of varying dimensions, which are intended to contain the objects or parcels. Each safe-deposit box 2 has a door 3 that can be kept in the closed position by a lock 4. The lock 4 includes, in a known manner, a catch plate that can be moved by an electromagnetic device (not shown) so that the lock can pass from a locked position, in which the door can be kept closed, to an unlocked position, in which the door 3 is released. The operation of causing the lock 4 to pass from the locked position to the unlocked position is controlled electrically, by the receipt of an open command, which may be in the form of a current pulse.

The safe-deposit box 2 also includes a position detector 5 that sends an electrical closed signal when the door 3 is in the closed position. The detector 5 is also designed to send an open signal when the door is open, either in the fully open position or in a half-open position. The position detector 5 may also be formed simply by an electrical contactor that prevents a current from flowing when the door is in the closed position and establishes an electrical connection when the door is open. However, the position detector 5 may of course be produced in a different fashion—in particular it may send a first coded message when the door is closed and a second coded message when the door is open. It is also conceivable to use several electrical contactors for producing the door position detector.

The door 3 of the safe-deposit box may be produced in the form of an armoured plate mounted so as to pivot on hinges, but it may also be made in the form of a sliding curtain, such as that described in French patent application filed under No. FR 02/12921 on Oct. 17, 2002.

The plurality of safe-deposit boxes 2 is divided into two parts, in the form of two columns. Each column of safe-deposit boxes is mounted in a rack (6*a*, 6*b*) placed above a base 7. The racks 6*a*, 6*b* are made from metal sections in which the safe-deposit boxes 2 can be removably mounted.

The storage device 1 includes a control panel 8 provided with a code entry device (9*a*, 9*b*) and with a screen 10.

In the embodiment shown, the code entry device comprises a bar code reader 9*a* and an alphanumeric keyboard 9*b*. The bar code reader 9*a* reads a code printed on the object to be deposited in the lockable storage device, while the keyboard 9*b* allows a user to enter his personal code when he comes to remove an object deposited beforehand. However, the code entry device could, of course, comprise other entry means such as, for example, a chip card reader.

The screen 10 provides communication between the user during the operation to deposit or withdraw an object, in particular to indicate if the code is correct and the safe-deposit box to be used, or to signal that the object ordered has not yet been deposited in one of the safe-deposit boxes 2 of the lockable storage device.

The lockable storage device also includes a control unit 11 placed in the control panel 8. The control unit 11 is connected to the code entry device (9*a*, 9*b*), to the screen 10, to the locks 4 and to the detectors 5 for detecting the position of the various doors 3.

The control unit 11 is designed to authorize an operation to deposit an object which, in the embodiment shown, is initiated by a bar code affixed to the object being read, but it could be initiated in another way, such as for example by actuating a pushbutton on the control panel 8.

The control unit 11 also authorizes an operation to withdraw a previously deposited object following entry of a withdrawal code and, of course, it is designed to keep the door 3 of the safe-deposit box 2, into which the object has been deposited, in the closed position between the deposition operation and the withdrawal operation. For security reasons, it is preferable for the doors 3 of the various safe-deposit boxes to be kept in the closed position, even when the boxes do not contain objects consigned thereto.

According to the invention, the lockable storage device includes a first weight sensor 14*a* placed between the rack 6*a* of the first column of safe-deposit boxes 2 and the base 7 and a second weight sensor 14*b* placed between the rack 6*b* of the second column and the base 7.

In the embodiment shown in FIG. 1, each weight sensor (14*a*, 14*b*) is subjected to the weight of the rack and the corresponding column of safe-deposit boxes, and each weight sensor is connected to the control unit 11.

The weight sensors (14*a*, 14*b*) are shown schematically by two rectangular elements placed beneath the racks 6*a* and 6*b*, respectively. These may be of any known type of weight sensor, however they must be sensitive enough to detect any object of significant weight, that is to say a weight sufficient to cause real damage. In general, it is considered that an object weighing more than 250 grams may be dangerous and consequently the measurement precision of the sensor must be better than this value.

Figure 3:
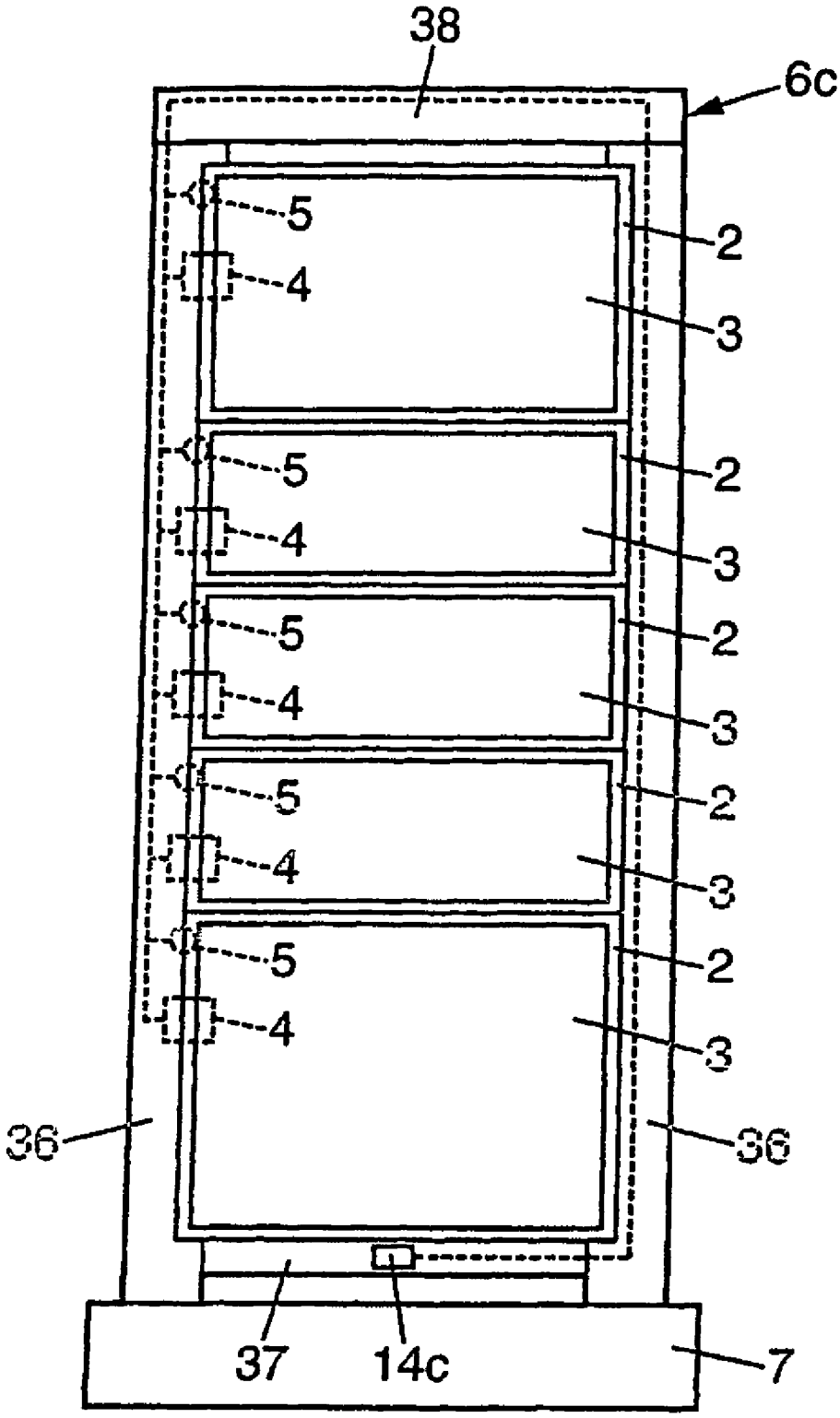
FIG. 3 is a partial view of a lockable storage device according to a second embodiment of the invention.

However, as may be seen in FIG. 3, the weight sensors may be placed in a different fashion. In this second embodiment, the safe-deposit boxes 2 slide vertically between vertical pillars 36 of the rack 6*c* and rest on a cross-member 37 that extends between two pillars 36. The cross-member 37 can deform under the weight of the safe-deposit boxes and it is provided with strain gauges. The weight sensor 14*c* is formed using these strain gauges, which deliver an electrical signal proportional to the deformation of the cross-member 37. Thus, the weight sensor 14*c* is subjected only to the weight of the safe-deposit boxes 2, and consequently the measurement by the sensor is not disturbed if the user deposits an object on the upper surface of the lockable storage device, this surface being formed by a plate 38 fastened to the top of the pillars 36.

The control unit 11 is designed:

- to authorize the operation to deposit an object in one particular safe-deposit box 2 among the various safe-deposit boxes of one or other of the racks (6*a*, 6*b*);
- to determine the weight of the object contained in this particular safe-deposit box after the deposit operation;
- to determine the change in weight of the safe-deposit boxes of the corresponding rack during the operation to withdraw this object; and
- to emit a warning signal after the withdrawal operation if said change does not correspond to the weight of this object that was determined.

Thus, if the user places a suspect object in the safe-deposit box after having withdrawn the consigned object, the control unit 11 emits a warning signal that allows suitable measures to be taken. For example, an audible and visual alarm is triggered, access to the lockable storage device is denied and/or a security service is alerted.

To fulfil these functions, the control unit 11 comprises the means described below and shown schematically in FIG. 2.

The control unit 11 includes recognition means 20 that are designed to recognize various deposit codes and various withdrawal codes.

Upon recognition of a deposit code, the recognition means 20 are designed to send an open command to the lock 4 of one particular safe-deposit box chosen from among those available at that moment and to store the identity of the safe-deposit box, in which this object is placed, in memory.

Upon recognition of a withdrawal code, the recognition means 20 are designed to send an open command to the lock 4 of the safe-deposit box into which the object corresponding to this withdrawal code was deposited. It should be noted that in this embodiment, the withdrawal code and the deposit code are customized for each object consigned, but it is conceivable for the codes to identify only the various users.

The control unit 11 includes a memory 21 and memory storage means 22 connected to the code recognition means 20, to the door position detector 5 and to the weight sensors (14*a*, 14*b*). The memory input means 22 are designed to write a first weight $W_1$ and a second weight $W_2$ into the memory. The memory 21 is a read/write memory. To increase the reliability of the system, this memory may be partly formed by a non-volatile memory so that the control unit 11 retains essential data, even in the event of a power failure.

Weight-determining means 23 are connected to the code recognition means 20 and to the position detector 5, which signal the start and the end of a deposit operation. To determine the weight of an object contained in one particular safe-deposit box 2 from first and second stored weights ($W_1$, $W_2$), the weight-determining means 23 calculate the difference between these two weights ($W_1$, $W_2$). The weight $W_0$ of the object in question thus determined is written into the memory 21.

Comparison means 24 are connected to the code recognition means 20 and to the position detector 5, which make it possible to signal to them the end of a withdrawal operation. The comparison means 24 are designed to compare the stored weight of the object that has been removed with the difference between the first and second stored weights ($W_1$, $W_2$) that correspond to the weight of all of the safe-deposit boxes 2 of the rack 6*a* or 6*b* before and after the removal of the object, respectively.

The control unit 11 also includes warning means 25 designed to emit a warning signal 35 according to the result transmitted by the comparison means 24.

The control unit 11 thus produced allows the operation of depositing an object in the lockable storage device and the operation of removing it therefrom to be carried out in the following manner.

The deposit operation comprises the following steps:

- a deposit code is recognized by the code recognition means 20;
- a signal is sent by the recognition means 20 to the memory input means 22;
- a first weight $W_1$ transmitted by the weight sensor 14*a* or 14*b*, depending on the safe-deposit box used, is stored in memory;
- an open command is sent by the recognition means 20 to the lock 4 of one particular safe-deposit box 2 chosen from among the set of safe-deposit boxes; and then
- a closed signal is sent by the door position detector 5 to the memory input means 22;
- a second weight transmitted by the weight sensor is stored in memory;
- a signal is sent by the recognition means to the weight-determining means 23;
- the weight $W_0$ of the object is determined by subtracting the second stored weight $W_2$ from the first stored weight $W_1$; and, finally
- the determined weight $W_0$ of this object is stored in memory.

The withdrawal operation comprises the following steps:

- a withdrawal code is recognized by the code recognition means 20;
- a signal is sent by the recognition means 20 to the memory input means 22;
- a first weight $W_1$ transmitted by the weight sensor (14*a*, 14*b*) is stored in memory;
- an open command is sent by the recognition means 20 to the lock 4 of the safe-deposit box associated with the object corresponding to the recognized withdrawal code; and then, later on,
- a closed signal is sent by the door position detector 5 to the memory input means 22;
- a second weight $W_2$ transmitted by the weight sensor is stored in memory;
- a signal is sent by the recognition means 20 to the comparison means 24;
- the stored weight $W_0$ of the object is compared with a difference between the first stored weight $W_1$ and the second stored weight $W_2$; and
- a warning signal 35 is emitted by the warning means 25 if the result transmitted by the comparison means 24 indicates that the difference between the first stored weight $W_1$ and the second stored weight $W_2$ does not correspond to the weight $W_0$ of this object that was stored in memory.

The control unit 11 may be constructed using any computing device, and especially using a microprocessor. The various means of the control unit are then produced by the various procedures of a computer program that controls the various operations of the lockable storage device.

Of course, it will be obvious to those skilled in the art that certain signals may follow a different path in the control unit and that the order of certain steps of the control process may be switched around.

Advantageously, the door position detector 5 is designed to send an open signal to the warning means 25, which emits a warning signal 35 depending on whether or not this open signal is received. The emission of a warning signal is then inhibited if the warning means do not receive a door opening signal during the withdrawal operation. This is because it may happen that the user, after having entered his withdrawal code, observes, through a transparent screen, or by partly opening the door of the safe-deposit box, that the object contained in the safe-deposit box does not correspond to the object that he had ordered. After the withdrawal operation, the object will not have been withdrawn by the user, but thanks to the absence of an open signal, indicating complete or partial opening of the door depending on the structure of the safe-deposit box, the warning means will not trigger an alarm.

Figure 2:
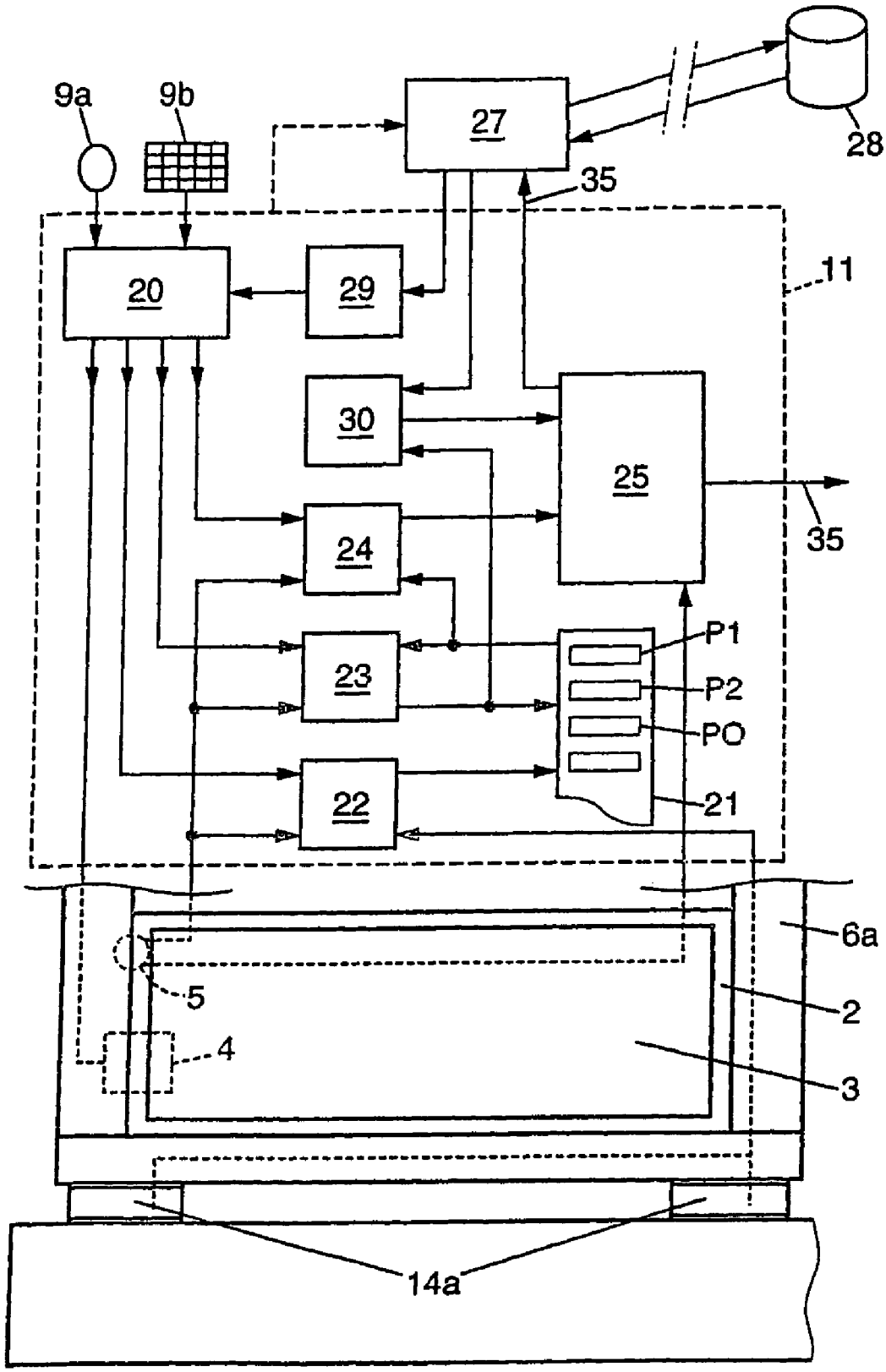
FIG. 2 is a block diagram of a control unit for controlling the lockable storage device shown in FIG. 1.

As shown in FIG. 2, the lockable storage device includes communication means 27 connected to a remote database 28 managed by the operator of the lockable storage device.

The communication means 27 are designed to receive information from the database 28 and in particular information relating to the deposit and withdrawal codes that must be recognized by the control unit 11. The control unit 11 then advantageously includes reprogramming means 29 that allow the recognition means 20 to be reprogrammed so that it can recognize new codes.

The operation of depositing an object is carried out by a delivery organization known to the operator of the lockable storage device, which, normally, provides all the guarantees against the possibility of a suspect or trapped object being deposited.

However, it is possible to increase the security of the system by associating, with the deposit code for an object, the expected weight of this object. The control unit 11 then includes control means 30 designed to compare the expected weight of an object that has to be deposited with the weight of this object determined when it is being deposited in the lockable storage device. The result of this comparison is sent to the warning means 25. Thus, during the deposit operation, the control unit 11 is designed to compare the determined weight of this object with the expected weight that was sent by the remote database 28 and to emit a warning signal 35 if the result transmitted by the control means 30 indicates a difference between the expected weight and the weight of this object that was determined. This feature makes it possible to detect whether a suspect object has been deposited using a deposit code, but also to verify whether the object deposited does indeed correspond to the anticipated object.

As a variant, it is also possible for the weight $W_0$ determined during the deposit operation to be transmitted to the remote database 28. By means of this information, the organization that manages the remote database, for example the vendor of the object, can detect that an abnormally heavy object has been deposited, even if this organization does not know the precise weight of the object. For example, if the vendor has despatched, via a transporting company, a bundle of ten journals and has received information indicating that an object weighing 15 kg has just been deposited, it can trigger an alarm. This information may also be useful for the vendor, so that it can verify the billing corresponding to the weight by the conveying company, without having to weigh the object before entrusting it to the transporting company.

The communication means 27 are used to send a warning signal 35 to the remote database 28 so that the operator of the lockable storage device is immediately aware that an anomaly has been detected.

The communication means are also advantageously designed to send, to the remote database 28, information relating to the signals sent by the various means (20 to 30) of the control unit 11. Thus, the operator of the lockable storage device can be informed, in real time, about the deposit and withdrawal operations and the various anomalies that may arise.

In the embodiment described above, the lockable storage device comprises several safe-deposit boxes associated with a single sensor. However, it will be obvious to those skilled in the art that the lockable storage device may comprise only a single safe-deposit box and a single weight sensor, or several safe-deposit boxes each one associated with a weight sensor.

The invention claimed is:

1. A lockable storage device for depositing an object and for withdrawing it, which comprises at least one safe-deposit box, intended to contain said object, which includes a door capable of being kept in the closed position by at least one lock, a code entry device and a control unit, said control unit being designed to authorize an operation to deposit an object and an operation to withdraw said object following the entry of a withdrawal code, and to control the operation of keeping the door in the closed position between said deposit operation and said withdrawal operation, wherein the lockable storage device includes at least one weight sensor subjected to the weight of said safe-deposit box and designed to transmit a signal representative of the weight of the safe-deposit box, and wherein the control unit is designed:

to determine the weight of the object contained in the safe-deposit box after a deposit operation;

to determine the change in weight of the safe-deposit box during an operation to withdraw said object; and to emit a warning signal at the end of the withdrawal operation if said change does not correspond to the weight of said object.

2. The lockable storage device as claimed in claim 1, in which the lock is designed to pass from a locked position, in which the door is kept closed, to an unlocked position, in which said door is released following receipt of an open command, in which device a position detector is designed to send a closed signal when the door is in the closed position, and wherein the control unit comprises:

code recognition means connected to the code entry device, which code recognition means are designed to recognize at least one deposit code and at least one withdrawal code and are designed to send an open command to said lock;

a readable/writeable memory memory input means connected to the code recognition means, to the position detector and to the weight sensor, the memory input means designed to write first and second weights of the safe-deposit box into said memory;

weight-determining means connected to the position detector and to the code recognition means, the weight-determining means designed to determine the weight of an object contained in the safe-deposit box from said first and second stored weights and to store in memory said weight of the object;

comparison means connected to the code recognition means and to the position detector, the comparison means designed to compare the stored weight of said object with the difference between the first and second stored weights;

warning means designed to emit the warning signal according to a result transmitted by the comparison means; and wherein the code recognition means are designed to send a signal to the memory input means following recognition of a deposit code or a withdrawal code, a signal to the weight-determining means following recognition of a deposit code, and a signal to the comparison means following recognition of a withdrawal code.

3. The lockable storage device as claimed in claim 2, wherein the position detector is designed to send an open signal when the door is open and wherein the warning means are designed to emit a warning signal according to the reception of said open signal.

4. The lockable storage device as claimed in claim 2, wherein communication means are designed to receive information relating to the withdrawal and deposit codes that are sent by a remote database and wherein the control unit includes means for reprogramming the code recognition means, which reprogramming means are connected to said communication means.

5. The lockable storage device as claimed in claim 4, wherein the information received by the communication means include a deposit code and an expected weight for an object associated with said deposit code, and wherein the control unit includes control means designed to compare said expected weight with the determined weight of said object after a deposit operation and to send the result of the comparison to the warning means.

6. The lockable storage device as claimed in claim 4, wherein the communication means are designed to transmit, to the remote database, the determined weight of an object after a deposit operation.

7. The lockable storage device as claimed in claim 4, wherein the communication means are designed to transmit, to the remote database, information relating to the emission of a warning signal by the warning means.

8. The lockable storage device as claimed in claim 4, wherein the communication means are designed to transmit, to the remote database, information relating to the signals sent by one or the other of the means of the control unit.

9. The lockable storage device as claimed in claim 1 and comprising at least one plurality of safe-deposit boxes, each of the plurality of safe-deposit boxes being provided with at least one lock, wherein the weight sensor is subjected to the weight of the plurality of safe-deposit boxes and wherein the control unit is designed:

to authorize the operation to deposit an object in one particular safe-deposit box among the plurality of safe-deposit boxes;

to determine the weight of the object contained in said particular safe-deposit box after the deposit operation;

to determine the change in weight of the plurality of safe-deposit boxes during the operation to withdraw the object from said particular safe-deposit box; and to emit a warning signal at the end of the withdrawal operation if said change does not correspond to the weight of said object.

10. The lockable storage device as claimed in claim 9, wherein the control unit includes:

code recognition means designed to recognize at least one deposit code and at least one withdrawal code;

a memory weight-determining means; and comparison means, wherein:

the code recognition means are designed to send an open command to the lock of one particular safe-deposit box following recognition of a code for depositing an object;

the means for determining the weight of the object are designed to store the weight of said object in memory, associating said weight with said particular safe-deposit box;

the code recognition means are designed to send an open command to said at least one lock of said particular safe-deposit box following recognition of a code for withdrawing said object; and the comparison means are designed to compare the stored weight of the object, associated with said particular safe-deposit box, with the change in weight of the plurality of safe-deposit boxes.

11. The lockable storage device as claimed in claim 8, wherein the plurality of safe-deposit boxes is mounted on a rack and wherein the weight sensor is subjected to the weight of said plurality of safe-deposit boxes.

12. The lockable storage device as claimed in claim 11, wherein the rack includes a deformable cross-member which deforms under the weight of the safe-deposit boxes and wherein the weight sensor comprises at least one strain gauge sensitive to the deformation of said cross-member.

13. The lockable storage device as claimed in claim 1 wherein the precision of the weight sensor is suitable for detecting any object of significant weight.

14. A method of depositing an object in a lockable storage device and for withdrawing it therefrom, said lockable storage device comprising at least one safe-deposit box that is intended to contain said object and includes a door that can be kept in the locked position by a lock, a code entry device and a control unit, said control unit being designed to authorize an operation to deposit an object and an operation to withdraw said object following the entry of a withdrawal code, and to control the operation of keeping the door in the closed position between said deposit operation and said withdrawal operation, wherein a weight sensor, subjected to the weight of said safe-deposit box and designed to transmit a signal representative of the weight of the safe-deposit box, is provided and wherein the method comprises the following steps:

determining the weight of the object contained in the safe-deposit box after a deposit operation;

determining the change in weight of the safe-deposit box after a withdrawal operation; and emitting a warning signal if said change does not correspond to the weight of said object.

15. The method of controlling a lockable storage device as claimed in claim 2, including a deposit operation and a withdrawal operation, wherein the deposit operation comprises the following steps:

recognizing a deposit code by the code recognition means;

sending a signal by the recognition means to the memory input means;

sending a signal by the recognition means to the weight-determining means;

sending an open command by the recognition means to the lock;

storing in memory a first weight transmitted by the weight sensor; and then, later, sending a closed signal by the detector, which detects the position of the door, to the memory input means; after which storing in memory a second weight transmitted by the weight sensor;

determining the weight of the object by taking the difference between the first stored weight and the second stored weight storing in memory the determined weight of the object;

and wherein the withdrawal operation comprises the following steps:

recognizing a withdrawal code by the code recognition means;

sending a signal by the recognition means to the memory input means;

sending a signal is-sent by the recognition means to the comparison means;

sending an open command by the recognition means to the lock;

storing in memory a first weight transmitted by the weight sensor; and then, later, sending a closed signal by the position detector, which position detector detects the position of the door, to the memory input means; then storing in memory a second weight transmitted by the weight sensor;

comparing the stored weight of said object with the difference between the first stored weight and the second stored weight; and emitting a warning signal if the result transmitted by the comparison means indicates that the difference between the first stored weight and the second stored weight does not correspond to the stored weight of the object.

16. The method as claimed in claim 15 for controlling a lockable storage device further comprising:

detecting the position of the door using a position detector designed to send an open signal;

inhibiting the warning means if the warning means do not receive a signal to open the door during the withdrawal operation.

17. The method as claimed in claim 15 for controlling a lockable storage device, which furthermore includes control means designed to compare an expected weight of an object with a determined weight after a deposit operation, wherein the deposit operation includes the following steps after the weight of the object has been determined:

comparing the determined weight of said object by the control means with the expected weight of said object; and emitting a warning signal if the result transmitted by the control means indicates a difference between the expected weight and the determined weight of said object.

* * * * *